US005999773A

United States Patent [19]

Yasutomi et al.

[11] Patent Number: 5,999,773

[45] Date of Patent: Dec. 7, 1999

[54] IMAGE FORMING APPARATUS AND CLEANING METHOD FOR CONTACT-CHARGING MEMBER

[75] Inventors: Kei Yasutomi; Hidetoshi Yano, both of Yokohama; Masako Yoshii, Kawasaki; Nobuto Yokokawa, Yokohama, all of Japan

[73] Assignee: Ricoh Company, Ltd., Tokyo, Japan

[21] Appl. No.: 09/096,467

[22] Filed: Jun. 12, 1998

[30] Foreign Application Priority Data

| | | | |
|---|---|---|---|
| Jun. 12, 1997 | [JP] | Japan | 9-155047 |
| Jun. 27, 1997 | [JP] | Japan | 9-187427 |
| May 15, 1998 | [JP] | Japan | 10-133186 |
| May 15, 1998 | [JP] | Japan | 10-152125 |

[51] Int. Cl.[6] ..... G03G 15/02

[52] U.S. Cl. ..... 399/148; 399/100; 399/174

[58] Field of Search ..... 399/99, 100, 50, 399/128, 129, 148, 168, 174, 343

[56] References Cited

U.S. PATENT DOCUMENTS

| | | | |
|---|---|---|---|
| 4,469,435 | 9/1984 | Nosaki et al. | 399/148 |
| 5,124,757 | 6/1992 | Ikegawa | 399/148 |
| 5,371,578 | 12/1994 | Asano et al. | 399/100 |
| 5,740,494 | 4/1998 | Shoji et al. | 399/71 |
| 5,758,229 | 5/1998 | Kyung | 399/100 |
| 5,765,076 | 6/1998 | Ogata et al. | 399/100 X |

FOREIGN PATENT DOCUMENTS 6-083166 3/1994 Japan .

8-062938 3/1996 Japan .

*Primary Examiner*—William Royer
*Assistant Examiner*—Sophia S. Chen
*Attorney, Agent, or Firm*—Oblon, Spivak, McClelland, Maier & Neustadt, P.C.

[57] ABSTRACT

An image forming apparatus includes a rotatable image bearing member and a contact-charging member which contacts a surface of the image bearing member. The contact-charging member can charge the image bearing member by applying a predetermined voltage to the contact-charging member so that a potential of the contact-charging member is changed to a required potential for transferring a residual toner that is stuck on a surface of the contact-charging member facing the image bearing member onto the image bearing member while the image bearing member stops rotating. A method for removing residual toner sticking onto a contact-charging member that contacts a surface of the image bearing member changes a potential of the contact charging member to a required cleaning potential for transferring the residual toner sticking to a surface of the contact-charging member facing the image bearing member onto the contact-charging member while the image bearing member stops rotating. The residual toner is then transferred from the surface of the contact-charging member facing the image bearing member onto the image bearing member, and the residual toner sticking to the surface of the contact-charging member facing the image bearing member is then removed.

19 Claims, 8 Drawing Sheets

IMAGE FORMING APPARATUS AND CLEANING METHOD FOR CONTACT-CHARGING MEMBER

BACKGROUND OF THE INVENTION

1. Field of the Invention

The present invention relates to an image forming apparatus using xerography, such as an electrostatic copying machine, a laser printer, or the like, and in particular, to an image forming apparatus having a contact-charging/toner-cleaning blade that removes residual toner from an image bearing member, and charges the image bearing member by contacting the image bearing member.

2. Discussion of the Background

A charging device that serves as a cleaning device that removes residual toner after image transfer from a surface of a photoconductive element and a charging device that uniformly charges the photoconductive element with a conductive blade are known.

For example, a charging device that charges and cleans the photoconductive element by contacting a conductive plate-shaped member onto a surface of the photoconductive element having a surface of an amorphous silicon layer is disclosed in Japanese Laid-Open Patent Publication No. 60-147756/1985.

Further, a blade whose electric resistance is in a range of $10^5$ to $10^9$ Ω and whose contacting pressure to the photoconductive element is at least 1.5 g/mm is disclosed in Japanese Laid-Open Patent Publication No. 7-92769/1995.

In these background arts, the blade scrapes off residual toner from the photoconductive element and charges the same downstream of the rotational direction of the photoconductive element. However, generally, the cleaning method using the blade cannot perfectly remove the residual toner from the photoconductive element, and about 2 to 10 pieces of residual toner may remain on the photoconductive element and that have been rubbed with the blade. Furthermore, both of positive and negative polarities exist in the residual toner in a mixed state, and in the toner that has been passed by the blade, both of the positive and negative polarities exist.

Accordingly, in a case of a N/P (negative-positive) transfer method, since a voltage of negative polarity has been applied to the blade when the toner of positive polarity passes by the blade, the toner sticks on the surface of the blade and a sticking amount of the toner of the positive polarity gradually increases. Therefore, an image quality deteriorates due to unevenness of the density of a half tone image because of unevenness of the charge on the photoconductive element after an elapse of extended periods of time.

FIG. 12 is a schematic diagram of an image forming apparatus using an electrophotographic process. A photoconductive drum (image bearing member) 101 is provided with a photoconductive element 101*a* on a surface of a conductive member 101*b* and rotates in a direction indicated by an arrow. A charging device 102, an exposing device 103, a developing device 104, a transfer device 105, and a cleaning device 106 are disposed around the photoconductive drum 101 and each of the devices is operated as follows.

The charging device 102 charges a surface of the photoconductive element 101*a* to a required potential. Then, the exposing device 103 exposes the surface of the photoconductive element 101*a* based on image data, and forms a latent image corresponding to the image data on the surface of the photoconductive element 101*a*. The developing device 104 develops the latent image formed by the exposing device 103 with toner, and thereby forms a toner image on the surface of the photoconductive element 101*a*. Thereafter, the transfer device 105 transfers the toner image formed on the surface of the photoconductive element 101*a* onto the transfer medium P conveyed with a conveying device (not shown). The transfer medium P on which a toner image is transferred by the transfer device 105 is then conveyed to a fixing device (not shown). Then, the transfer medium P is disposed outside of the apparatus after the toner image is fixed, e.g. with heat.

On the other hand, the cleaning device 106 scrapes off any residual toner remaining on the surface of the photoconductive element 101*a* at a post-transfer, and cleans the surface of the photoconductive element 101*a*. Hereupon, the background image forming apparatus has been provided with the cleaning device 106 and the charging device 102 individually.

FIG. 13 shows an example of a cleaning device used in a background image forming apparatus. The cleaning device 106 is constructed with a cleaning blade 106*a* as a main element. The cleaning blade 106*a* is made of a urethane rubber. The cleaning blade 106*a* is formed, for example, with a thickness of 2 mm and a width of about 300 mm and is supported by a supporting member 106*b*. A tip end portion of the cleaning blade 106*a* projects from a tip end of the supporting member 106*b*, and the projecting length of the tip end portion is adjusted to, for example, 8 mm.

Further, a supporting angle θ (an inclining angle tangential to the photoconductive element 101*a*) of the cleaning blade 106*a* is 20°, and an amount b of the cleaning blade that cuts into the residual toner on the photoconductive element 101*a* is adjusted to approximately 1.2 mm. The thus constructed cleaning blade 106*a* scrapes off any residual toner that is stuck on the photoconductive element 101*a* by cutting into the residual toner.

On the other hand, a so-called contact-charging device is widely used as a charging device 102, other than a corona-charging device such as a background scorotoron. The contact-charging device charges the photoconductive element 101*a* by contacting a charging member to the photoconductive element 101*a* and applying a voltage to the charging member.

FIG. 14 shows an example of the background contact-charging device. The contact-charging device is provided with a charging member 107. The charging member 107 has an elastic layer 107*a* at a peripheral surface of a conductive member 107*b* and is formed in a cylindrical shape with a diameter of, for example, 5 mm to 20 mm, and a width of, for example, approximately 300 mm. The charging member 107 is driven by a rotation of the photoconductive element 101*a* contacting the charging member 107. The elastic layer 107*a* of the charging member is composed of a conductive member having a resistivity of about $10^7$ through $10^9$ Ω cm. Further, a surface protecting layer having a thickness of about 10 through 20 μm may be formed at the surface (the surface of the elastic member layer 107*a*) of the charging member 107. A predetermined charging voltage is applied to the charging member 107 by a power source 108, and thereby, the photoconductive element 101*a* is charged. Generally, the charging voltage is about DC −1.0 kV to −1.5 kV.

As mentioned above, the background image forming apparatus that is individually provided with both the cleaning device 106 and the charging device 102 has a shortcoming that the entire apparatus has a large structure. This is because the apparatus requires both of a cleaning space and a charging space around the photoconductive drum 101. Furthermore, since the cleaning device 106 and the charging device 102 are constructed as individual members, a large number of parts is required and manufacturing costs become high. To solve such a problem, an image forming apparatus having a contact-charging/cleaning blade is proposed in, for example, Japanese Laid-Open Patent Publication No. 56-165166/1981, and Japanese Laid-Open Patent Publication No. 7-92767/1995.

FIG. 15 shows a schematic diagram of a contact-charging/cleaning blade provided in such a background image forming apparatus. The contact-charging/cleaning blade 110 is formed with approximately the same measurements and configuration as the above-mentioned cleaning blade 106. Namely, the contact-charging/cleaning blade 110 is formed, for example, with a thickness of 2 mm and a width of about 300 mm. The tip portion of the contact-charging/cleaning blade 110 projects from the tip portion of a supporting member 111, and the projecting amount a is adjusted to, for example, 8 mm. The contact-charging/cleaning blade 110 is connected to a power source 112.

Further, a supporting angle θ of the contact-charging/cleaning blade 110 (the inclining angle of the cleaning blade 110 tangential to the photoconductive drum 101*a*) is 20°, and the amount b of the cleaning blade 110 that cuts into the residual toner on the photoconductive element 101*a* is adjusted to approximately 1.2 mm. In such a construction of the contact-charging/cleaning blade 110, an edge part of the cleaning blade 110 cuts into the residual toner that sticks to the photoconductive element 101*a,* and scrapes off the residual toner from the photoconductive element 101*a.*

Furthermore, this contact-charging/cleaning blade 110 is arranged with an electric resistance of approximately $10^6$ to $10^9$ by scattering carbon and ion conductive material over the urethane rubber. In addition, a voltage is applied to the contact-charging/cleaning blade 110, similarly to the aforementioned charging member 107, and the contact-charging/cleaning blade 100 charges the photoconductive element 101*a.* In general, the charging voltage is about −1.0 kV DC to −1.5 kV DC.

In the image forming apparatus provided with the aforementioned background contact-charging/cleaning blade 110, there has been a possibility of the following problem occurring when the image forming apparatus is used for extended periods of time. Namely, the residual toner that sticks onto the photoconductive element 101*a,* even after transfer, has been considered to be removed by the edge part of the contact-charging/cleaning blade 110.

However, actually, even in a slight amount, the residual toner passes between the edge part of the contact-charging/cleaning blade 110 and the surface of the photoconductive element 101*a.* It is considered that a slight vibration of the charging cleaning blade 110 itself, or a vibration that is applied to the charging cleaning blade 110 at a time of starting a rotation of the photoconductive element 101*a* or at a time of stopping the photoconductive element 101*a,* may be the reason for the aforementioned problem. Furthermore, a part of the residual toner that has passed by the edge part of the contact-charging/cleaning blade 110 sticks to the surface of the blade 110 contacting the photoconductive element 101*a,* downstream of the edge part of the blade 110.

The reason why the toner thus sticks to the contact-charging/cleaning blade 110 is considered to be as follows. In an image forming apparatus of a so-called negative-positive development method, toner that is charged to a positive polarity (a reverse polarity to the charging polarity of the photoconductive element 101*a*) by an electric discharge at a time of transfer or the like exists in the residual toner on the photoconductive element 101*a* at post-transfer. Further, when the toner passes by the contact-charging/cleaning blade 110, a positive charged toner due to friction with the blade 110 exists. Furthermore, in a so-called positive-positive development method, the toner itself is charged to a positive polarity.

On the other hand, since a high voltage of the negative polarity is applied to the contact-charging/cleaning blade 110 when the toner passes by the blade 110, the residual toner of the positive potential sticks onto the contact-charging/cleaning blade 110 at the negative potential. Further, if the toner that is stuck to the contact-charging/cleaning blade 110 is stacked for extended periods of time, the electric discharge that occurs between the blade 110 and the photoconductive element 101*a* becomes uneven, and the photoconductive element 101*a* cannot be uniformly charged. Accordingly, a problem of an abnormal image formation occurs.

To solve such a problem, there is also proposed a device for previously charging (pre-charging) the residual toner on the photoconductive element 101*a* to a negative polarity, i.e., the same polarity as the polarity of the voltage to be applied to the contact-charging/cleaning blade 110, before the residual toner passes by the contact-charging/cleaning blade 110, see Japanese Laid-Open Patent Publication No. 7-325459/1995. However, in a case of adopting such a device, it is required to dispose a charging device for charging the residual toner to the negative polarity around the photoconductive drum 101, and accordingly, both of the previously discussed problems, a large sized configuration of the image forming apparatus and high costs due to a large number of the parts, cannot be avoided.

SUMMARY OF THE INVENTION

The present invention is made in light of the above problems. According to the present invention, in a case of using a blade that serves for both charging and cleaning of a photoconductive element, an unevenness of charging that increases along with elapsing time is prevented.

The present invention provides a novel image forming apparatus capable of removing residual toner that is stuck onto a contact-charging/cleaning blade at a surface contacting a photoconductive element with a simple construction. Thereby, the present invention can provide a novel image forming apparatus capable of producing a good quality image that is maintained for extended periods of time.

As one feature, the novel image forming apparatus of the present invention includes an image bearing member which is capable of rotating and a contact-charging member which contacts a surface of the image bearing member.

The contact-charging member is capable of charging the image bearing member by applying a predetermined voltage to the contact-charging member in which a potential of the contact-charging member is switched to a required potential capable of transferring a residual toner that is stuck on a surface of the contact-charging member facing the image bearing member onto the image bearing member while the image bearing member stops rotating.

As one feature, the present invention also includes a novel method for removing residual toner that sticks on a contact-charging member that contacts a surface of an image bearing member for an image forming apparatus, which is capable of rotating, which includes steps of changing a potential of the contact charging member to a required cleaning potential capable of transferring residual toner that sticks on a surface of the contact-charging member facing the image bearing member onto the contact-charging member while the image bearing member stops rotating, transferring the residual toner on the surface of the contact-charging member facing the image bearing member onto the image bearing member, and removing the residual toner stuck on the surface of the contact-charging member facing the image bearing member.

A contact-charging member contacts a surface of an image bearing member which is capable of rotating, and the image bearing member is charged with the contact-charging member to which a predetermined charging voltage is applied.

The novel image forming apparatus can also include an image bearing member reverse-rotating device that rotates the image bearing member in a reverse direction as in an image forming operation, and a voltage selecting device that switches a voltage applied to the contact-charging member to be different from the voltage in a time period of the image forming operation, while the image bearing member is rotated in the reverse direction as in the image forming operation.

A novel method of forming an image in the present invention may also include the steps of contacting a surface of a rotating image bearing member with a contact charging member, charging the image bearing member by applying a predetermined charging voltage to the contact-charging member, rotating the image bearing member in a rotation reverse to a rotation direction of the image bearing member in an image forming operation, switching the voltage that is applied to the contact-charging member to a voltage different from a voltage in the image forming operation, transferring a residual toner stuck on the contact-charging member onto the image bearing member, and removing the transferred residual toner from the image bearing member in a next image forming operation.

The voltage selecting device can, as an example, switch the voltage applied to the contact-charging member to a voltage different from the voltage in the image forming operation by grounding the contact-charging member while the image bearing member is rotating in the reverse direction.

The voltage selecting device can, as an alternative example, switch the voltage applied to the contact-charging member to a voltage different from the voltage in the image forming operation by superimposing an AC component on a DC voltage while the image bearing member is rotating in the reverse direction.

The voltage selecting device can also switch the voltage applied to the contact-charging member to a voltage different from the voltage in the image forming operation just after a stopping signal for stopping the image bearing member is transmitted.

An image bearing member reverse-rotating device can rotate the image bearing member in a reverse direction to a position where a part of the surface of the image bearing member in which the toner is transferred from the contact-charging member passes a cleaning member which cleans the surface of the image bearing member, when the image bearing member reverse-rotating device rotates the image bearing member in a direction reverse to a direction of the image forming operation.

BRIEF DESCRIPTION OF THE DRAWINGS

A more complete appreciation of the present invention and many of the attendant advantages thereof will be readily obtained as the same becomes better understood by referring to the following detailed description when considered in connection with the accompanying drawings, wherein.

DESCRIPTION OF THE PREFERRED EMBODIMENTS

Figure 1:
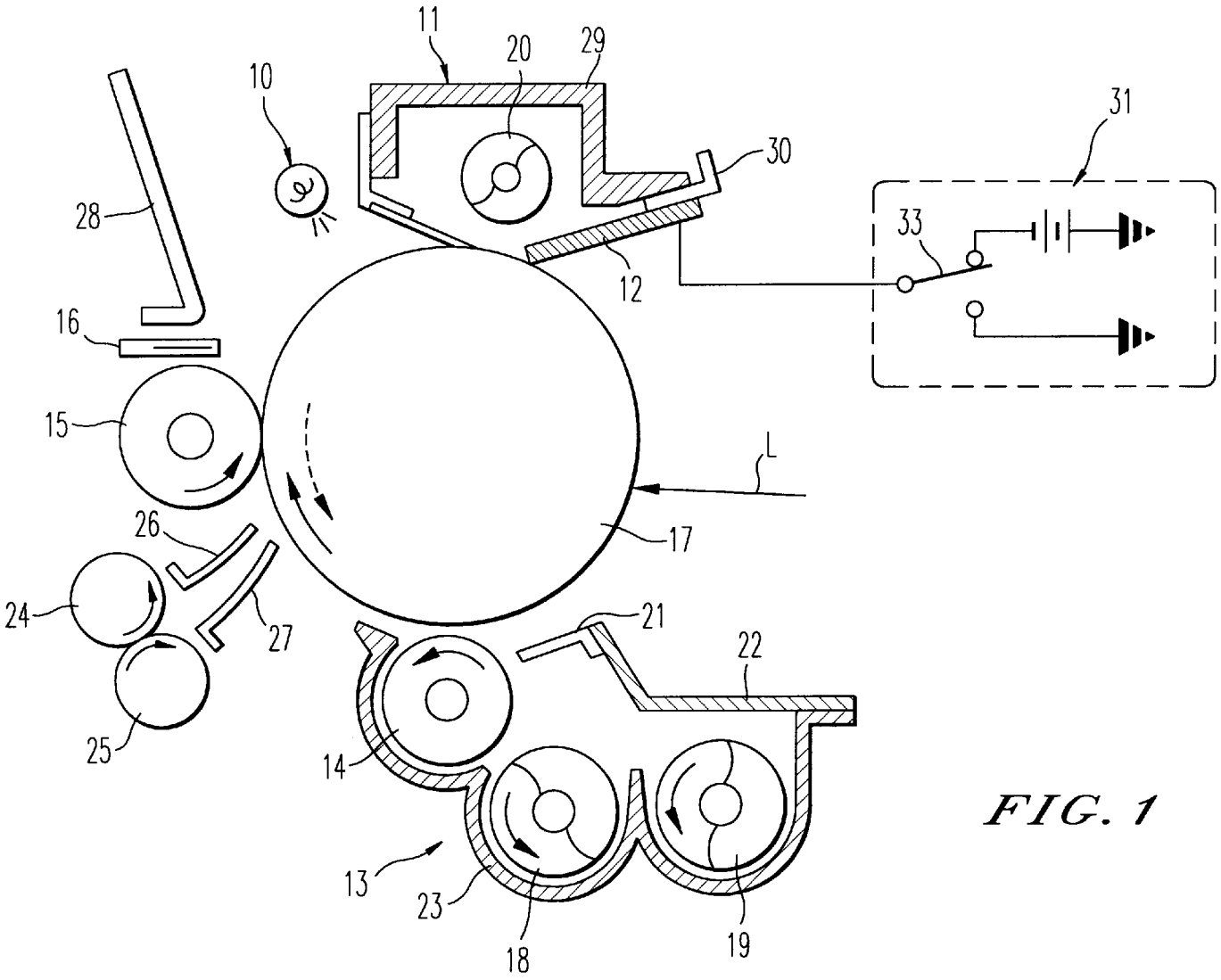
FIG. 1 is a schematic diagram of an image forming apparatus relevant to a first embodiment of the present invention.

A first embodiment of the present invention is explained in detail referring to the drawings, wherein like reference numerals indicate identical or corresponding parts throughout the several views.

A series of an image forming process is hereinbelow explained referring to FIG. 1.

When a print button of an operating section (not shown) in an image forming apparatus is pushed, a predetermined voltage or current is applied in order to a discharging lamp 10, a blade 12 of a cleaning-charging device 11, a developing roller 14 of a developing device 13, a transfer roller 15, and a separation pole 16, in a predetermined timing. In addition, at approximately the same time, a drum-shaped photoconductive element 17, the developing roller 14, a left screw 18 and a right screw 19 of the developing device 13, the transfer roller 15, and a toner discharging screw 20 of the cleaning device 11 start to rotate in a predetermined direction.

The photoconductive element 17 is discharged by the discharging lamp 10 along with the clockwise rotation thereof indicated by an arrow of a solid line FIG. 1, and is uniformly charged to a negative polarity (for example, −850V) with the blade 12 of the cleaning-charging device 11 that contacts the surface of the photoconductive element 17 at a distant position from the discharging section. The photoconductive element 17 is then exposed with a laser beam L from an exposing device (not shown) and a latent image (a potential of the solid image is, for example, −150V) is formed on the surface of the photoconductive element 17. The latent image is developed with a magnet brush that is composed of a developing roller 14 (a voltage that is applied is, for example, −650V) and a visible toner image is thereby formed. Further, numeral 21 is a doctor blade of the developing device 13, numeral 22 is an upper lid, and numeral 23 is a lower case.

On the other hand, a transfer sheet that is conveyed by a sheet feeding mechanism (not shown) is synchronized with a leading edge of the image by an upper registration roller 24 and a lower registration roller 25. The transfer sheet is then conveyed between the photoconductive element 17 and the transfer roller 15, being guided by an upper guide plate 26 and a lower guide plate 27. Further, a toner image on the photoconductive element 17 is transferred (a transferring current is, for example, +10 $\mu$A) onto the transfer sheet, and then the transfer sheet is separated from the photoconductive element 17 by the separation pole 16. The transfer sheet is then conveyed to a fixing unit (not shown) being guided with a conveying guide plate 28, and the transfer sheet is then discharged out of the apparatus after the toner image has been fixed thereon.

Residual toner that remains in the above-mentioned transferring process is conveyed to the cleaning-charging device 11 with the clockwise rotation of the photoconductive element 17. The residual toner is then removed from the photoconductive element 17 with the blade 12. Further, the toner is discharged from an inside of a cleaning case 29 of the cleaning-charging device 11 with a toner discharging screw 20.

Furthermore, the photoconductive element 17 is discharged with the discharging lamp 10 before being cleaned by the cleaning-charging device 11. The discharging manner as mentioned above is to irradiate diffused reflection of light, and therefore a remaining charge on the photoconductive element 17 is discharged in an approximately uniform state.

The blade 12 is held in the cleaning case 29 by a blade holder 30. The blade 12 is made of a conductive material. A voltage of a negative polarity is applied to the blade 12 by a power source 31 for charging, and accordingly the photoconductive element 17 is charged at the same time as the cleaning operation after the discharging operation of the discharging lamp 10.

On the other hand, since the toner on the photoconductive element 17 cannot be perfectly scraped off even if the cleaning operation is executed with a general blade, about 2 to 10 toners remain on the photoconductive element 17 after the cleaning operation. Further, both positive and negative polarities exist in a mixed state in the toner at a post-transfer station.

Figure 2:
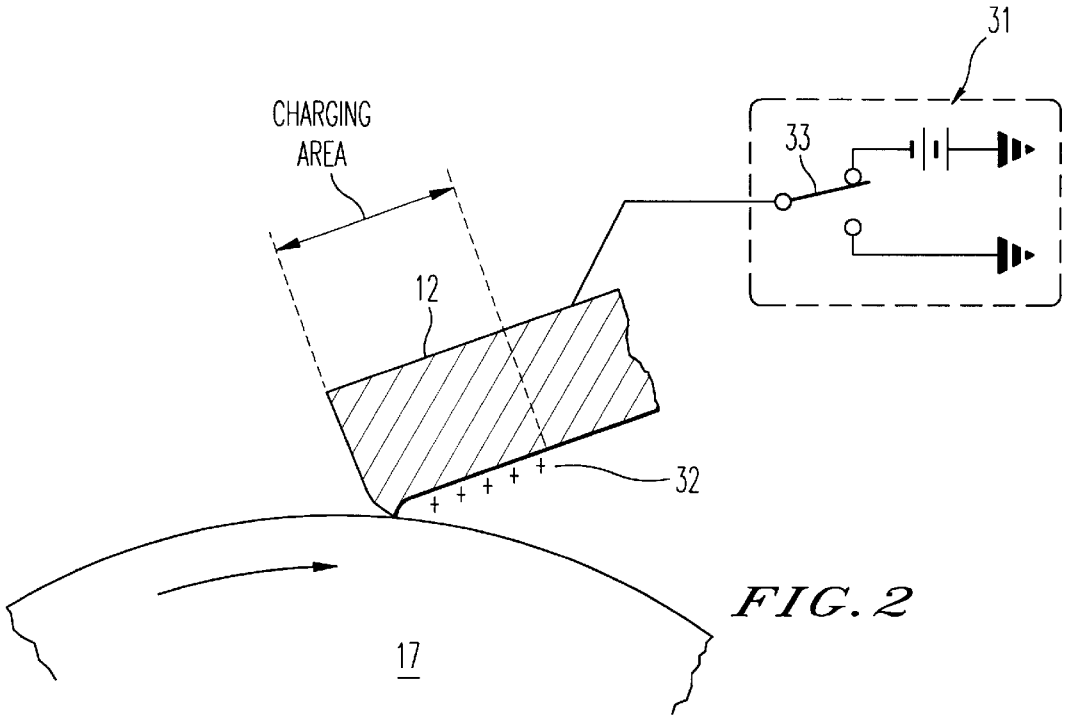
FIG. 2 is an explanatory view that shows a rotation of a photoconductive element and a voltage applying state to a blade in an image forming operation.

Accordingly, and with reference to FIG. 2, when the toner 32 of a positive polarity has passed by the blade 12 by clockwise rotation of the photoconductive element 17 indicated by the solid line in FIG. 1 at a time of forming an image on the photoconductive element 17, the toner 32 of the positive polarity is attracted to the blade 12 to which a voltage of a negative polarity is applied by the power source 31 for charging, and is stuck on the surface of the blade 12, as shown in FIG. 2. If the blade 12 is used for extended periods of time, the surface of the blade 12 gradually become dirty, and a background fouling of the image is caused due to an unevenness of charging on the photoconductive element 17 occurring.

Figure 3:
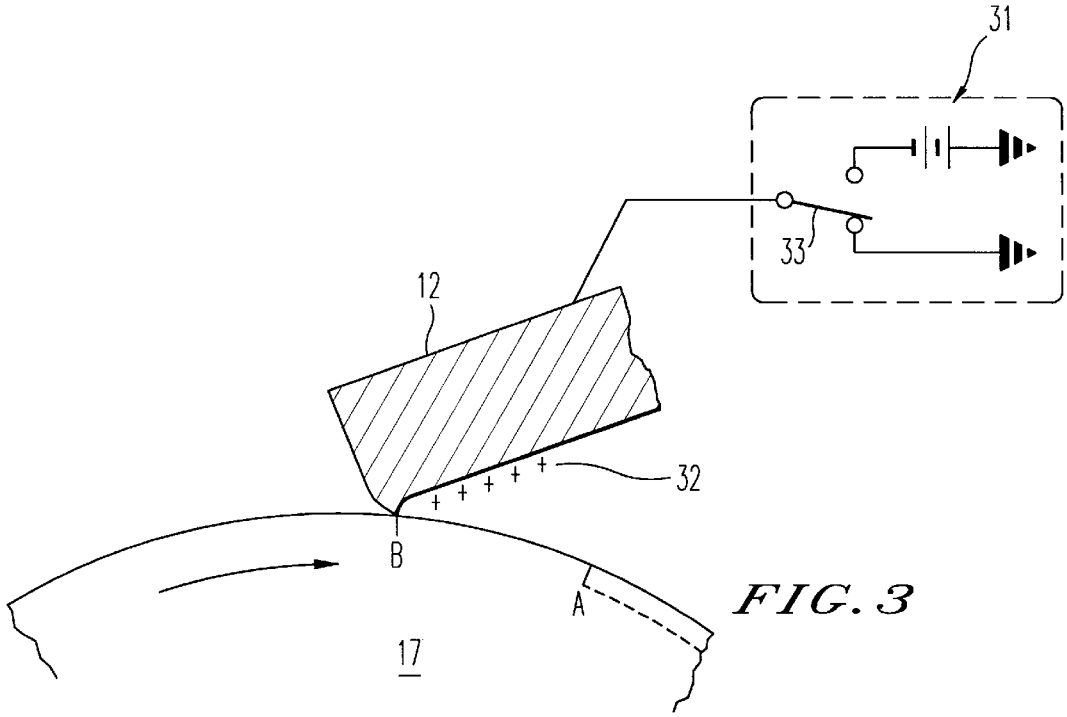
FIG. 3 is an explanatory view of an operation when a charging power source for a blade is switched to ground just after transmitting a stopping signal for a photoconductive element.
Figure 4:
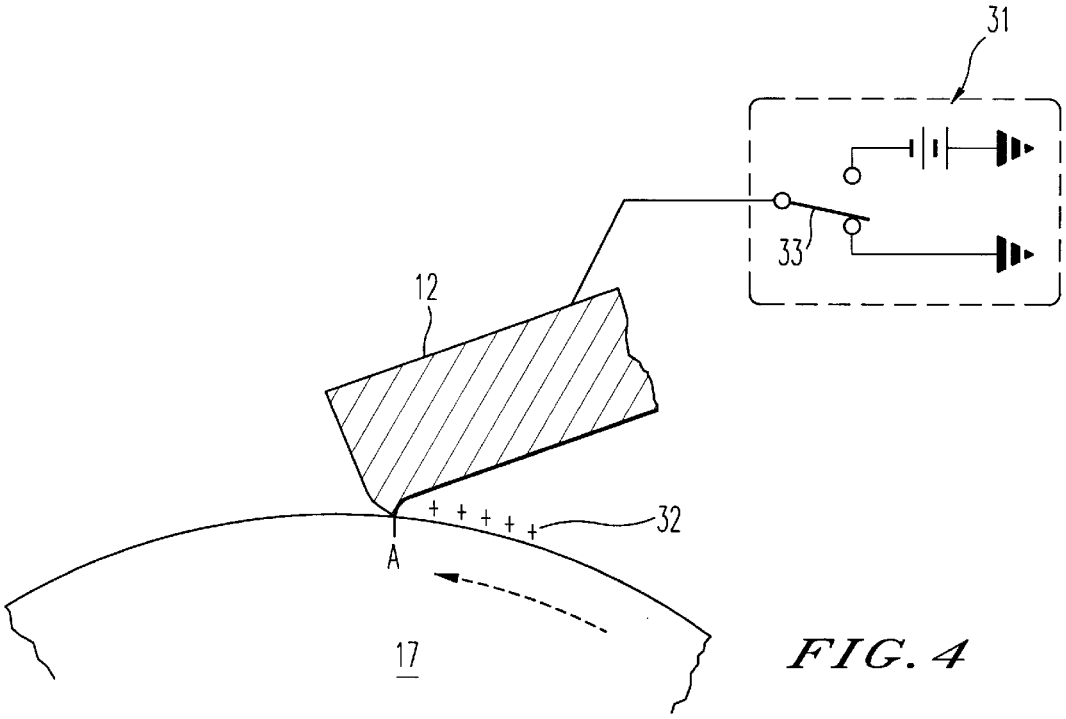
FIG. 4 is an explanatory view of an operation when toner is transferred from a blade to a photoconductive element rotating in a reverse direction.

Therefore, in the present invention, a voltage-selecting switch 33 is mounted on the power source 31 for charging. Further, a reverse rotational function for the photoconductive element 17 (a control function for a reverse rotation of a motor of the photoconductive element) that rotates the photoconductive element 17 having an image formed thereon in a reverse direction to the direction of rotation in an image forming operation is provided in a control section (not shown). Furthermore, the reverse rotational function for the photoconductive element transmits a stopping signal for stopping the photoconductive element 17 on which an image has been formed. Just after the stopping signal is transmitted, the blade 12 to which the voltage of the negative polarity has been applied is grounded by switching the voltage selecting switch 33 as shown in FIG. 3. With reference to FIG. 4, the photoconductive element 17 is then rotated in a reverse direction (a direction indicated by the broken line arrow) for a required amount of the rotation, waiting until the photoconductive element 17 completely stops and an amount of inertia rotation is obtained.

In other words, unless a compulsory stopping device is individually prepared for the photoconductive element 17, the motor that rotates the photoconductive element 17 is rotated by inertia and then stops, even though a stopping signal to the photoconductive element 17 is transmitted. For example, if a stopping signal is transmitted when a point A on the photoconductive element 17 reaches a contacting position with the blade 12, the photoconductive element 17 completely stops at a position where a new point B contacts the blade 12 as shown in FIG. 3. Further, since the blade 12 is grounded, the charging operation for the photoconductive element 17 after the point A has contacted the blade 12 is not executed.

Accordingly, even though a part of the surface on the photoconductive element 17 from the point A to the point B is not charged, the part on the photoconductive element 17 that is upstream of the point A is charged to the predetermined potential of the negative polarity by the blade 12 to which the negative polarity voltage is applied.

Therefore, the photoconductive element 17 is rotated in a reverse direction (indicated by an arrow of a broken line in FIG. 4) until the point A passes over the contact point of the blade 12 to a predetermined amount therefrom so that the toner 32 of a positive polarity that is stuck on the blade 12 is transferred from the blade 12, which is grounded, to the negatively charged part of the photoconductive element 17. The toner 32 that is stuck on the blade 12 is transferred onto the photoconductive element 17 by this reverse rotation. At this moment, since the blade 12 contacts the photoconductive element 17 in a trailing direction, the blade 12 scarcely has a force for scraping off the toner 32. The toner 32 of the positive polarity that is transferred from the blade 12 onto the photoconductive element 17 does not again stick onto the blade 12 that is grounded during the reverse rotation of the photoconductive element 17. The toner 32 thereby easily passes through the contact portion of the blade 12 and the photoconductive element 17 and moves to the left side of the contact part of the blade 12.

The toner 32 that has moved to the left side of the contact portion of the blade 12 is again cleaned by the blade 12 when the photoconductive element 17 rotates clockwise for an image forming operation. Hereupon, the voltage selecting switch 33 is switched back to the previous state (as shown in FIG. 2), the negative voltage is again applied to the blade 12 from the power source 31 and the photoconductive element 17 is again charged.

Accordingly, even though the Q/M (an amount of the charge per unit) of the toner 32 has been decreased due to an elapsing of extended periods of time after the image forming apparatus is turned off when the image forming operation is again executed, shortcomings such as toner scattering and the like do not occur.

The aforementioned operation such as the voltage change of the blade 12 by grounding and the reverse rotation of the photoconductive element 17 can be executed once for every transfer of a certain number of the sheets, or every one job (for example, for every one copying operation). Further, even though the voltage change of the blade 12 is executed by grounding in the aforementioned example, the toner can also be transferred from the blade 12 to the photoconductive element 17 by superimposing an AC component onto the DC voltage.

On the other hand, the blade 12 is used in the aforementioned construction of the image forming apparatus of the present invention serving as both of a contact-charging member and a cleaning member. However, the present invention is applicable to an image forming apparatus having both of a contact-charging member exclusively used for charging a surface of an image bearing member and a separate cleaning member exclusively used for cleaning residual toner on the image bearing member positioned at an upstream thereof. When the image bearing member rotates in a direction reverse to a rotation direction in the image forming operation, the image bearing member rotates to a position where the part of the image bearing member to which the residual toner has been transferred from the contact-charging member to the image bearing member passes the cleaning member. In addition, the cleaning member removes toner on the surface of the image bearing member when the image bearing member rotates in the direction of the image forming operation, when the next image forming operation is executed.

Figure 5:
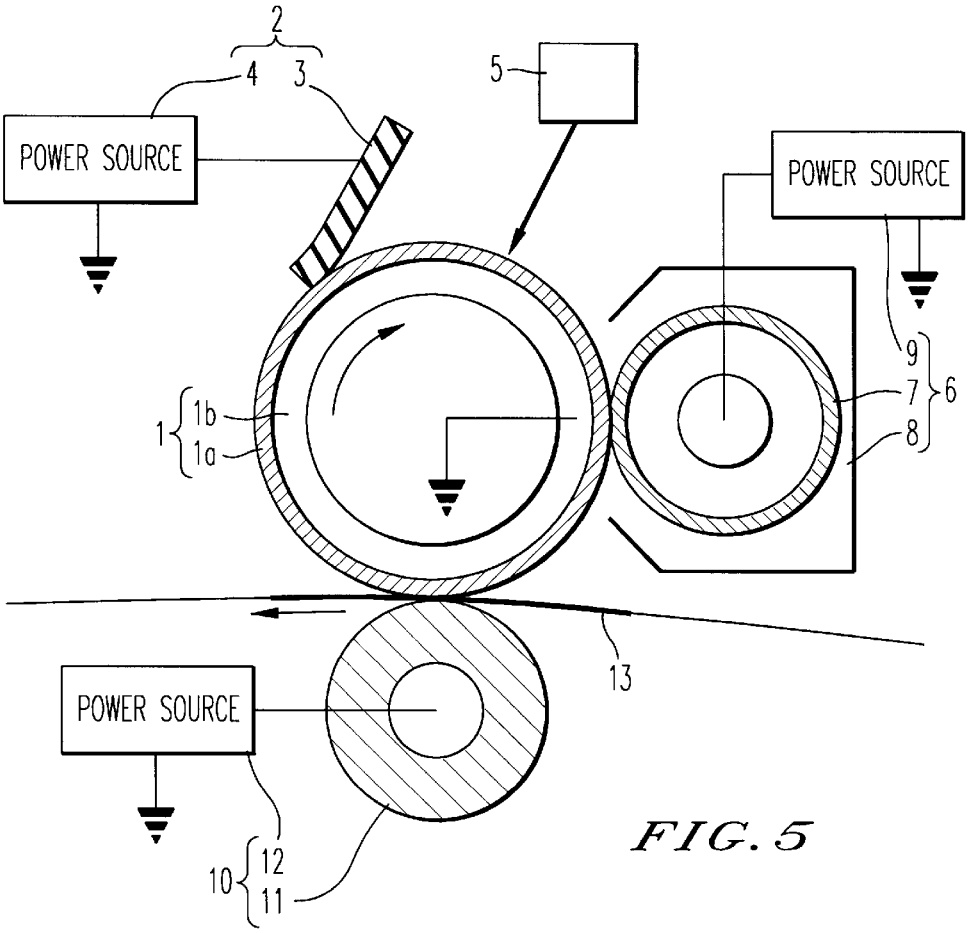
FIG. 5 is a construction showing a schematic diagram of an image forming apparatus relevant to a second embodiment of the present invention.

FIG. 5 is a construction showing a schematic diagram of an image forming apparatus relevant to a second embodiment of the present invention. An image forming apparatus is provided with a contact-charging/cleaning device 2, an exposing device 5, a developing device 6, and a transfer device 10 around a photoconductive drum 1 (image bearing member).

The photoconductive drum 1 is formed by applying a photoconductive element 1*a* on a conductor 1*b* and rotates in a direction indicated by an arrow in FIG. 5. The photoconductive drum 1 rotates, for example, at a circumferential speed of 180 mm/sec. The contact-charging/cleaning device 2 is provided with a contact-charging/cleaning blade (hereinafter may be abbreviated to "blade") 3, which is made from a conductive elastic material, and a power source 4. The edge part of the blade 3 contacts the photoconductive element 1*a*. A predetermined voltage is applied to the blade 3 by the power source 4.

The exposing device 5 forms an electrostatic latent image on the photoconductive element 1*a* that is uniformly charged with the contact-charging/cleaning device 2, by exposing light that corresponds to desired image data. For example, a laser diode is used as a light source of the exposing device 5. A laser beam reflected from an original document via a polygon mirror scans the photoconductive element 1*a* being irradiated thereto.

The developing device 6 is provided with a developing roller 7, a developer container 8, and a power source 9. This developing device 6 applies a predetermined voltage (for example, −0.6 kV) to the developing roller 7. The developing device 6 converts the latent image on the photoconductive element 1*a* to a toner image (reverse development) by applying a developer to the surface of the photoconductive element 1*a* with the developing roller 7. As for the developer, a two-component developer that contains carrier and toner, or a one-component developer composed of just toner, can be used.

The transfer device 10 transfers a toner image formed on the photoconductive element 1*a* with a developing device 6 onto a transfer medium 13 that is conveyed from a feeding section (not shown), e.g., a sheet feeding section. The transfer device 10 is provided with a transfer roller 11 and a power source 12, and is constructed for applying a predetermined voltage to the transfer roller 11 from the power source 12. The power source 12 is controlled at a constant current, for example, 20 $\mu$A. The transfer medium 13 onto which a toner image is transferred is conveyed to the fixing device (not shown) and the toner image is fixed thereon.

Figure 6:
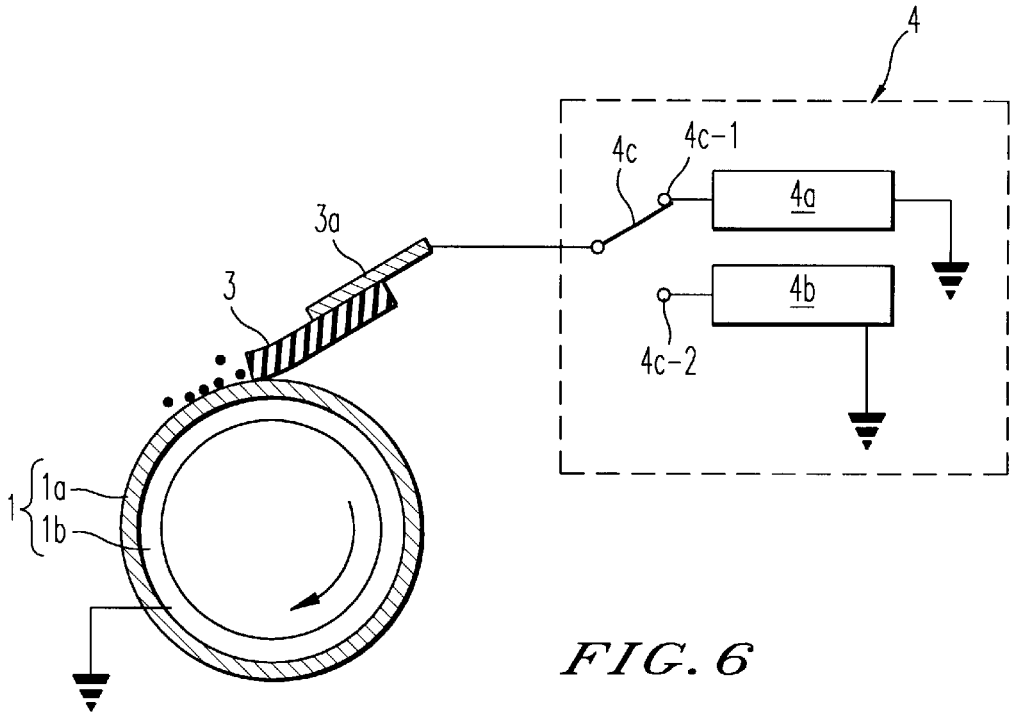
FIG. 6 is a construction illustrating a contact-charging/cleaning blade in FIG. 5 in detail.

FIG. 6 is a construction for explaining the contact-charging/cleaning device 2 shown in FIG. 5 in greater detail. The blade 3 is formed, for example, to a thickness of 2 mm and a width of 300 mm and is held by a supporting member 3*a*. The tip end portion of the blade 3 projects from the tip end of the supporting member 3*a*, and the projecting amount of the blade 3 is adjusted, for example, to 8 mm.

Further, in this embodiment, a supporting angle (the inclining angle of the blade 3 tangential to the photoconductive element 1*a*) of the blade 3 is adjusted to 20°, and the amount of blade 3 cutting into the residual toner on the photoconductive element 1*a* is adjusted to approximately 1.2 mm. The blade 3 in such a construction cuts into the residual toner that is stuck on the photoconductive element 1*a* with the edge part thereof and scrapes off the residual toner from the photoconductive element 1*a*.

Furthermore, the blade 3 is conductive as the blade 3 can be made from an urethane rubber including ionic compounds such as halogenides or alkali metal salts. However, a material that composes the blade 3 may be composed of other than the above-mentioned materials. For example, rubber or resin in which a conductivity is added may be applicable for the blade 3. Furthermore, carbon-added electronic conductive material may be employed.

The power source 4 is provided with a first power source section 4*a* and a second power source section 4*b*, and is provided with a selecting switch 4*c* that switches between the respective power source sections 4*a* and 4*b* and connects to the blade 3. The first power source section 4*a* is connected to a fixed contact-point 4*c*-1 of the selecting switch 4*c* and is provided for outputting a charging voltage (for example, −1.8 kV) that is required for charging the photoconductive element 1*a* for an image formation operation.

On the other hand, the second power source section 4*b* is connected to a fixed contact-point 4*c*-2 of the selecting switch 4*c* and is provided for outputting a cleaning voltage that is required for removing the toner stuck on the blade 3.

Further, in the second and fifth embodiments described later, the second power source section 4*b* is not necessary and the fixed contact-point 4*c*-2 of the selecting switch 4*c* can be grounded. In addition, in the third and fourth embodiments, the second power source section 4*b* is provided and the predetermined cleaning voltage from the power source section 4*b* is applied to the cleaning blade 3 as shown in FIG. 6.

Figure 7:
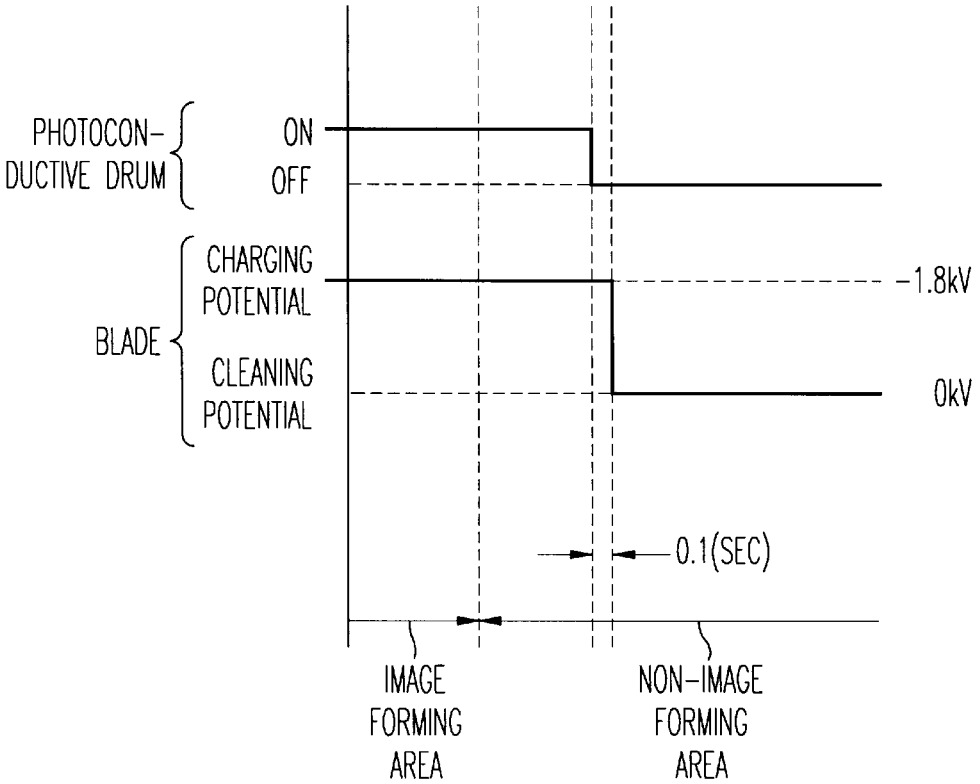
FIG. 7 is a timing chart explaining an image forming apparatus relevant to the second embodiment of the present invention.

FIG. 7 is a timing chart for explaining an image forming apparatus relevant to the second embodiment of the present invention. In the second embodiment, a charging voltage (−1.8 kV) that is necessary for charging the photoconductive element 1*a* is applied to the blade 3 during rotation of the photoconductive drum 1. This charging voltage is output from the first power source section 4*a* shown in FIG. 6. The edge part of the blade 3 contacts the photoconductive element 1*a* and charges the surface of the photoconductive element 1*a* to a predetermined charging potential (about −0.8 kV) by applying the aforementioned charging voltage.

Thereafter, the selecting switch 4*c* is switched to the fixed contact-point 4*c*-2 side in a constant timing after the photoconductive drum 1 has stopped driving along with finishing the image forming operation and the blade 3 is brought to a cleaning potential. In this second embodiment, the fixed contact-point 4*c*-2 of the selecting switch 4*c* is grounded. Accordingly, the cleaning potential of the blade 3 becomes a ground potential (0 V).

Since the switching operation for the potential of the blade 3 is executed after the photoconductive drum 1 has stopped driving, even though the potential of the blade 3 becomes the cleaning potential (0 V), the contacting surface of the blade 3 to the photoconductive element 1*a* is kept at a charging potential (about −0.8 kV). Namely, the blade 3 is at the cleaning potential of 0 V, and the photoconductive element 1*a* is at the charging potential of about −0.8 kV. On the other hand, the toner stuck on the blade 3 is charged to a positive potential as described before.

Figure 8:
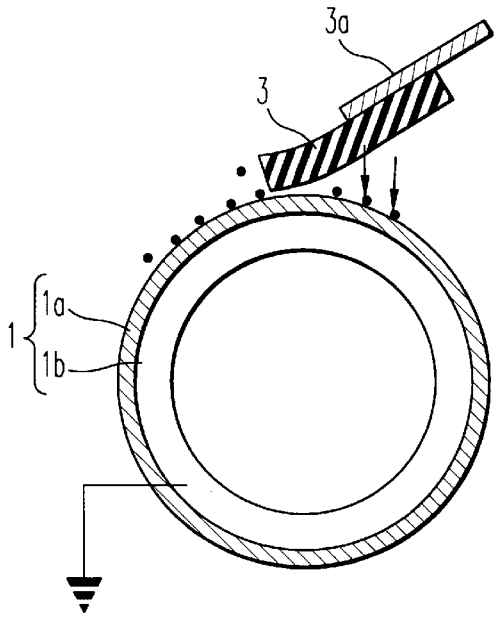
FIG. 8 is a model chart illustrating a state of toner stuck on a blade that is attracted to a photoconductive element at an image forming apparatus relevant to the second embodiment of the present invention.

Therefore, the toner charged to the positive potential is attracted and stuck to the photoconductive element 1*a* that has a voltage higher than that of the blade 3, as shown in FIG. 8. Thus the toner stuck on the blade 3 can be removed. Further, the selecting timing for the cleaning potential of the blade 3 after the driving of the photoconductive drum 1 has been stopped can be set to an interval of 0.1 sec. in this embodiment, although the selecting timing can be set without limitation of the interval as stated above.

In the second embodiment, since the cleaning potential of the blade 3 is set to the ground potential, a special power source (the second power source section 4*b* in FIG. 6) is not required. Accordingly, the number of parts and costs of the device can be decreased.

Figure 9:
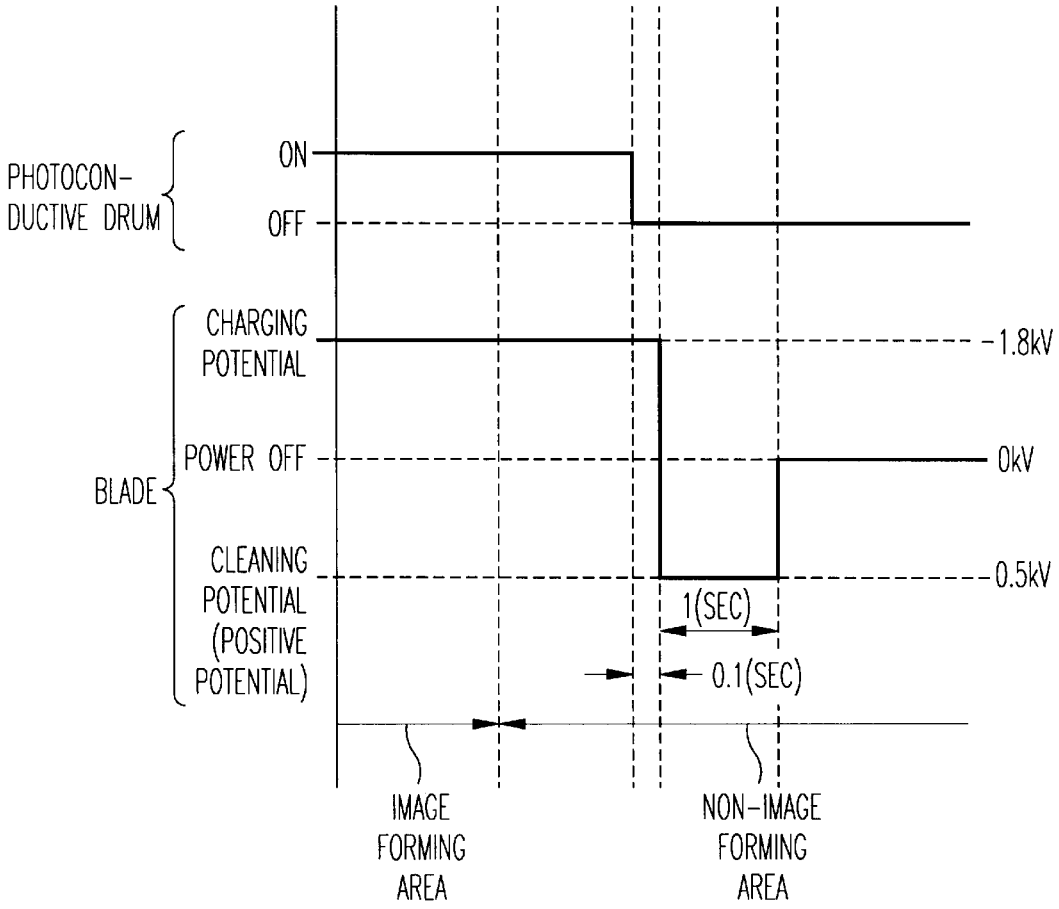
FIG. 9 is a timing chart explaining an image forming apparatus relevant to a third embodiment of the present invention.

FIG. 9 is a timing chart that explains an image forming apparatus relevant to a third embodiment of the present invention. The charging voltage (−1.8 kV) that is required for charging the photoconductive element 1 a is applied to the blade 3 while the photoconductive drum 1 rotates. The charging voltage is output from the first power source section 4*a* shown in FIG. 6. The edge part of the blade 3 contacts the photoconductive element 1*a* and charges the surface of the photoconductive element 1*a* according to the aforementioned charging voltage to a required charging potential (about −0.8 kV).

Thereafter, when the driving operation of the photoconductive drum 1 is stopped along with the ending of the image forming operation, the selecting switch 4*c* is switched to the fixed contact-point 4*c*-2 side in a constant timing. Thereby, the blade 3 attains a state of the cleaning potential. In this embodiment, the fixed contact-point 4*c*-2 of the selecting switch 4*c* is connected to the second power source 4*b* (see FIG. 6) as stated above. Accordingly, the potential of the blade 3 attains the predetermined cleaning potential by the cleaning voltage applied from the second power source 4*b*.

The output voltage (DC) of the second power source 4*b* is set so that the cleaning potential attains the potential of a reverse polarity to that of the charging voltage of the photoconductive element 1*a* (for example, +0.5 kV). Since the potential change of the blade 3 is executed after stopping the driving of the photoconductive drum 1, even though the potential of the blade 3 attains the cleaning potential (+0.5 kV), the surface of the photoconductive element 1*a* that faces the blade 3 is kept at the charging potential (about −0.8 kV).

Namely, in this moment, the blade 3 is at the cleaning potential of +0.5 kV and the photoconductive element 1*a* is at the charging potential of −0.8 kV. At the same time, as described above, the toner stuck on the blade 3 has been charged to a positive potential. Accordingly, the toner at the positive polarity and the blade 3 charged to the same positive polarity (+0.5 kV) repel each other as shown in FIG. 8. Further, since the toner is attracted by the photoconductive element 1*a* having a potential of the reverse polarity (−0.8 kV) to that of the toner, the toner can further surely be removed from the blade 3 in comparison with the second embodiment.

Furthermore, the selecting timing for the cleaning potential of the blade 3 after the driving of the photoconductive drum 1 has been stopped can also be set to an interval of 0.1 sec. in the third embodiment, although the selecting timing can be set without limitation of the interval as stated above. The voltage applied to the blade 3 can also be changed to 0 V, and a series of the operation ends after a constant time period (for example, 1 sec.) has elapsed from the time when the blade 3 is set to the cleaning potential.

Figure 10:
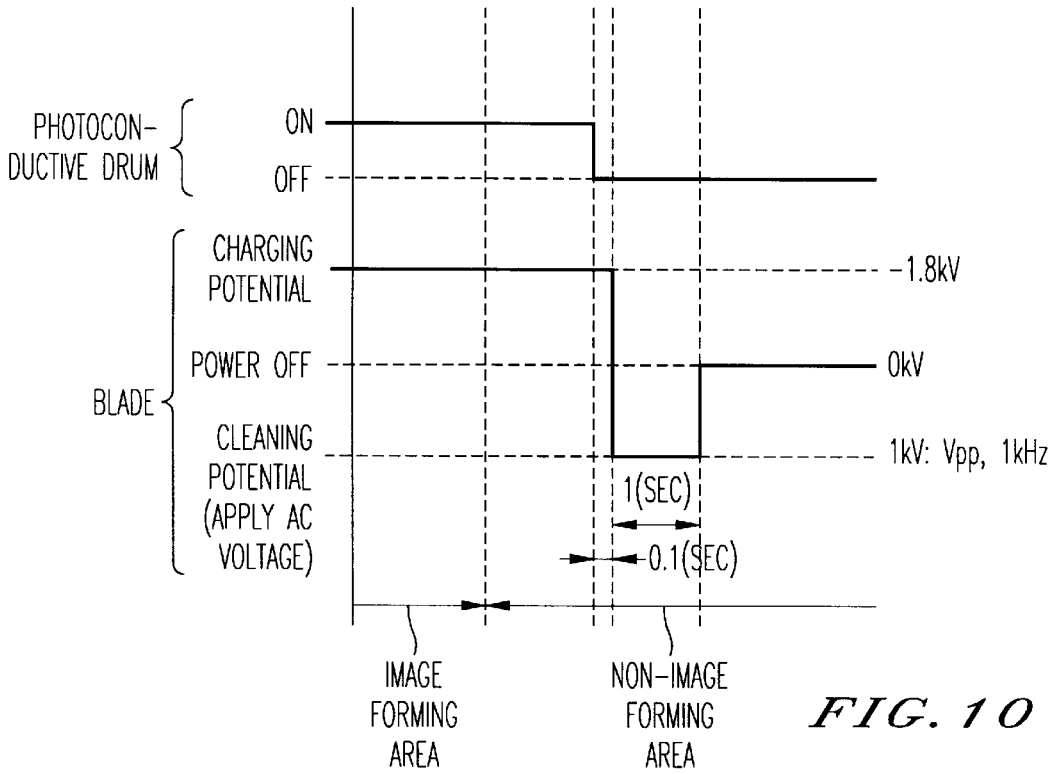
FIG. 10 is a timing chart explaining an image forming apparatus relevant to a fourth embodiment of the present invention.

FIG. 10 is a timing chart for explaining an image forming apparatus relevant to a fourth embodiment of the present invention. In this embodiment, the charging voltage (−1.8 kV) required for charging the photoconductive element 1*a* is also applied to the blade 3 for image formation, while the photoconductive drum 1 is rotating. This charging voltage is output from the first power source section 4*a* shown in FIG. 6. The edge part of the blade 3 contacts the photoconductive element 1*a,* and charges the surface of the photoconductive element 1*a* to a required potential (about −0.8 kV) by applying the aforementioned charging voltage.

After the driving of the photoconductive drum 1 has been stopped in accordance with an ending of the image forming operation, the potential of the blade 3 becomes equal to the cleaning potential by switching the selecting switch 4*c* to the fixed contact-point 4*c*-2 in a constant timing. The fixed contact-point 4*c*-2 of the selecting switch 4*c* is connected to the second power source 4*b* (see FIG. 6) as described above. Thereby, the potential of the blade 3 becomes equal to the predetermined cleaning potential by applying the cleaning voltage from the second power source 4*b*.

The second power source 4*b* can output a predetermined AC voltage (for example, an AC voltage having an amplitude of 1.0 kV and a frequency of 1 KHz). An electric vibration is thereby added to the toner stuck on the blade 3 by applying such an AC voltage to the blade 3, and thereby the toner can easily be removed from the blade 3.

Since the potential change of the blade 3 is executed after the driving of the photoconductive drum 1 is stopped, if the blade 3 potential becomes equal to the cleaning potential, the contacting surface of the blade 3 at the photoconductive element 1*a* is kept at the charging potential (about −0.8 kV). That is, at this moment, the blade 3 is put at the cleaning potential that varies at an amplitude of 1.0 kV and at a frequency of 1 KHz. The photoconductive element 1*a* is still at the charging potential of about −0.8 kV. On the other hand, the toner stuck on the blade 3 is charged to a positive polarity as described above.

Accordingly, the toner can be easily removed from the blade 3 by the electric vibration. Further, since the toner is attracted by the photoconductive element 1*a* at the potential of the reverse polarity (−0.8 kV), the toner can further surely be removed from the blade 3 in comparison with the aforementioned embodiments. The selecting timing for applying the cleaning potential of the blade 3 after the driving of the photoconductive drum 1 has been stopped can also be set to an interval of 0.1 sec. in this third embodiment, although the selecting timing can be set without limitation of the interval as stated above Further, the amplitude and the frequency of the AC voltage applied to the blade 3 can be set without limitation. However, the attracting force between the toner and the blade 3 that is larger than that between the toner and the photoconductive element 1*a* can preferably be prevented from occurring by determining an amplitude less than that of the charging potential of the photoconductive element 1*a*. Furthermore, a series of operations can end applying 0 V to the blade 3 after a constant period of time (for example, 1 sec.) has elapsed from the time point of applying the cleaning potential to the blade 3.

Figure 11:
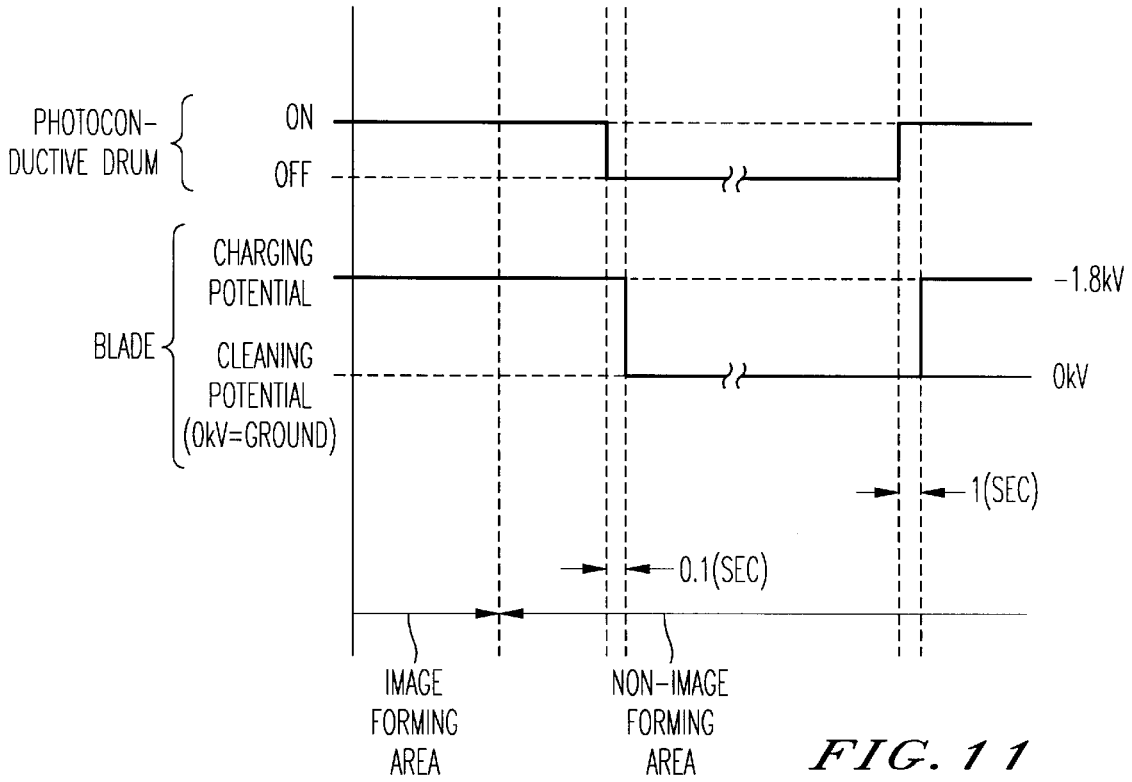
FIG. 11 is a timing chart explaining an image forming apparatus relevant to a fifth embodiment of the present invention.
Figure 12:
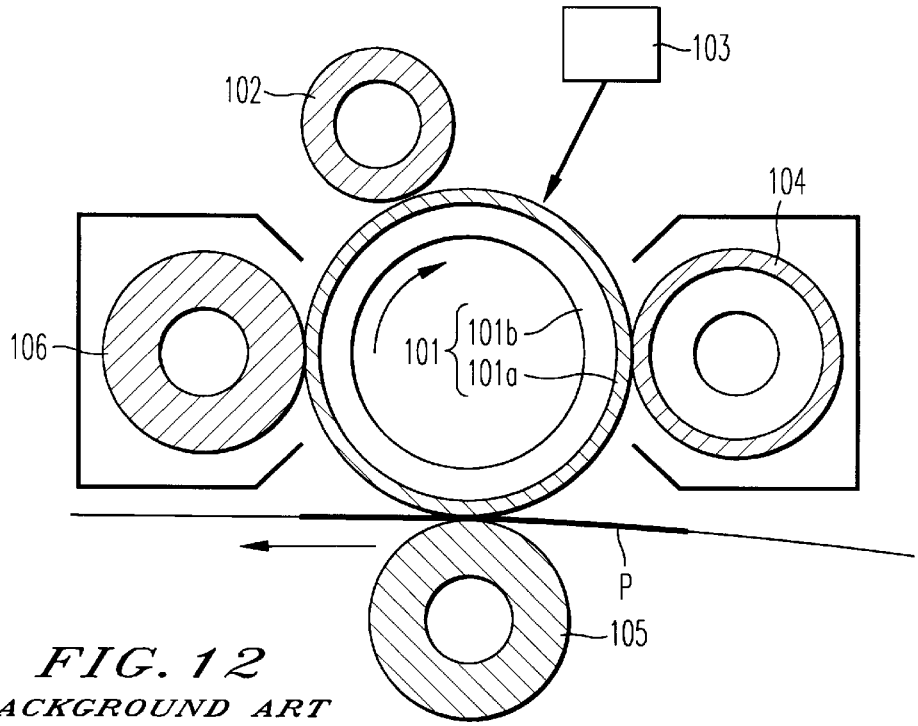
FIG. 12 BACKGROUND ART
FIG. 12 is a schematic construction of an image forming apparatus using an electrophotographic process.
Figure 13:
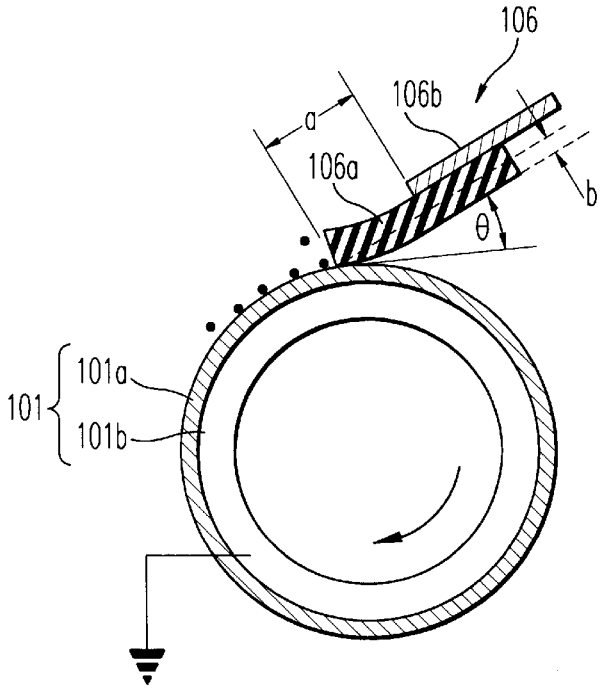
FIG. 13 BACKGROUND ART
FIG. 13 is a schematic construction of an image forming apparatus showing an example of a cleaning device used for a background image forming apparatus.
Figure 14:
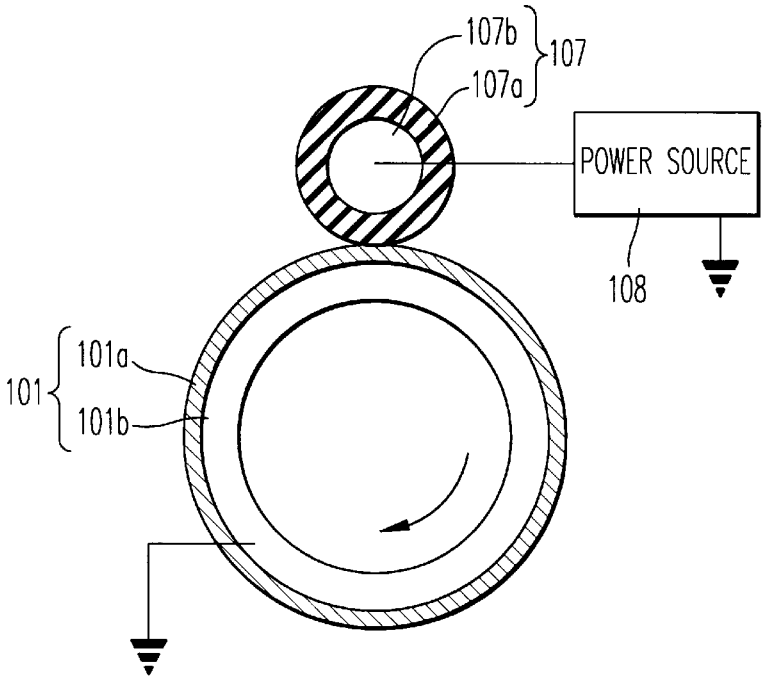
FIG. 14 BACKGROUND ART
FIG. 14 is a schematic construction showing an example of a background contact-charging device.
Figure 15:
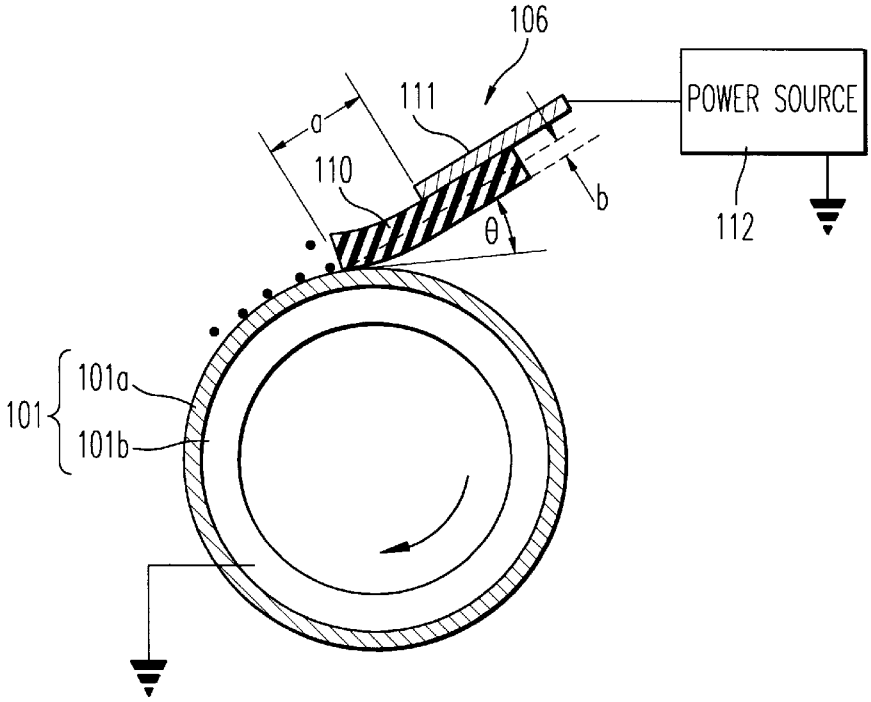
FIG. 15 BACKGROUND ART
FIG. 15 is a schematic construction showing a contact-charging/cleaning blade that is provided in a background image forming apparatus.

FIG. 11 is a timing chart explaining an image forming apparatus relevant to a fifth embodiment of the present invention. In this embodiment, the removing operation of the toner stuck on the blade 3, which is executed after the image forming operation is finished, is executed in a same manner as described in the aforementioned second embodiment. In addition, a charging voltage is further applied to the blade 3 with a constant delayed time after starting the driving of the photoconductive drum 1.

Namely, a charging voltage (e.g., −1.8 kV) required for charging the photoconductive element 1*a* is applied to the blade 3 for image formation, while the photoconductive drum 1 is rotating. This charging voltage is output from the first power source section 4*a* as shown in FIG. 6. The edge part of the blade 3 contacts the photoconductive element 1*a* and charges the surface of the photoconductive element 1*a* to a required charging potential (about −0.8 kV) by the aforementioned charging voltage.

After the driving of the photoconductive drum 1 has been stopped in accordance with ending the image forming operation, the selecting switch 4*c* is switched to the fixed contact-point 4*c*-2 side at a constant timing. Thereby, the potential of the blade 3 becomes equal to the cleaning potential. In the second embodiment, the fixed contact-point 4*c*-2 of the selecting switch 4*c* is grounded as described before. Accordingly, the cleaning potential of the blade 3 is the ground potential (0 V).

Since the potential change of the blade 3 is executed after stopping the driving operation of the photoconductive drum 1, the potential on the contacting surface of the blade 3 at the photoconductive element 1*a* is kept equal to a charging potential (about −0.8 kV), even though the blade 3 becomes equal to the cleaning potential (0 V). Namely, the blade 3 is put to the cleaning potential of 0 V and the photoconductive element 1*a* is still at the charging potential of about −0.8 kV. On the other hand, as described before, the toner that is stuck on blade 3 is charged to a positive potential.

Therefore, the toner charged to the positive potential is transferred to the photoconductive element 1*a* that has a higher voltage than the blade 3 by being attracted to the photoconductive element 1*a*. Thus, the toner that is stuck on the blade 3 can be removed. Thereafter, when the image forming operation is started again, the photoconductive drum 1 is driven, while the charging voltage is not applied to the blade 3. Thereby, the part of the photoconductive element 1*a* on which the toner (transferred from the blade 3) is stuck moves downstream from the position contacting the blade 3.

Next, the first power source section 4*a* is connected to the blade 3, by switching the selecting switch 4*c* of the power source 4 to the fixed contact-point 4*c*-1 with a constant delayed timing (for example, 0.1 sec.). Since the portion on the photoconductive element 1*a* on which the toner is stuck has already moved downstream, the toner is not again attracted to the blade 3, even though the charging voltage (−1.8 kV) is applied to the blade 3. Further, the selecting timing for the cleaning potential of the blade 3 after the driving of the photoconductive drum 1 has been stopped can be set to an interval of 0.1 sec. in this embodiment, although the selecting timing can be set without limitation of the interval as stated above.

Furthermore, the delay timing of applying the charging voltage to the blade 3 after starting the photoconductive drum 1 can be set without limitation.

The present invention is not limited to the above described embodiments. For example, the cleaning potential for removing the toner that is stuck on the blade 3 can be set to the potential of the same polarity (negative polarity) if the absolute value of the charging potential is less than that of the photoconductive element 1*a*.

Furthermore, the cleaning potential of the aforementioned fifth embodiment is set to the ground potential (0 V). However, the cleaning potential can be set to a potential of reverse polarity to the charging potential without limitation of the embodiment in a same manner as that of the fourth embodiment. Furthermore, the cleaning potential can be constructed so as to apply the AC voltage to the blade 3 in a same manner as that of the fourth embodiment.

Furthermore, the present invention is applicable, in the same manner as described in the aforementioned embodiments, to an image forming apparatus in which a cleaning device and charging blade are disposed around the photoconductive drum (image bearing member), and a cleaning device and charging blade are individually mounted around the image bearing member.

Having now fully described the invention, it will be apparent to one of ordinary skill in the art that many changes and modifications can be made thereto without departing from the spirit and scope of the present invention as set forth herein.

This application is based on Japanese Patent Application No. 09-155047, filed on Jun. 12, 1997, and No. 09-187427 filed on Jun. 27, 1997, respectively, the entire contents of which are herein incorporated by reference.

We claim:

1. An image forming apparatus comprising:

a rotatable image bearing member;

a contact-charging member which contacts a surface of said image bearing member, said contact-charging member to charge said image bearing member by applying a predetermined voltage to said contact-charging member, wherein a charging potential of said contact-charging member is changed to a cleaning potential for transferring a residual toner that is stuck on a surface of said contact-charging member facing said image bearing member onto said image bearing member while said image bearing member stops rotating;

wherein said contact-charging member is a blade, a part of said blade contacting a surface of said image bearing member; and wherein the cleaning potential has a potential of a reverse polarity to a charging potential of said image bearing member.

2. The image forming apparatus according to claim 1, wherein said contact-charging member serves as a cleaning member that cleans a surface of said image bearing member.

3. The image forming apparatus according to claim 1, wherein the charging voltage is applied to said contact-charging member after said image bearing member starts rotating.

4. An image forming apparatus comprising:

a rotatable image bearing member;

a contact-charging member which contacts a surface of said image bearing member, said contact-charging member to charge said image bearing member by applying a predetermined voltage to said contact-charging member, wherein a charging potential of said contact-charging member is changed to a cleaning potential for transferring a residual toner that is stuck on a surface of said contact-charging member facing said image bearing member onto said image bearing member while said image bearing member stops rotating, and wherein the cleaning potential is formed by applying an AC voltage to said contact-charging member.

5. A method for removing residual toner sticking to a contact-charging member that contacts a surface of a rotatable image bearing member for an image forming apparatus, comprising steps of:

changing a charging potential of said contact charging member to a cleaning potential for transferring residual toner sticking to a surface of said contact-charging member facing said image bearing member onto said image bearing member while said image bearing member stops rotating;

transferring the residual toner on the surface of said contact-charging member facing said image bearing member onto said image bearing member; and removing the residual toner stuck on the surface of said contact-charging member facing said image bearing member;

wherein said contact-charging member is a blade, a part of said blade contacting a surface of said image bearing member;

wherein in the changing step the cleaning potential has a potential of a reverse polarity to the charging potential of said image bearing member.

6. The method recited in claim 5, wherein said contact-charging member is a blade, a part of said blade contacting a surface of said image bearing member.

7. An image forming apparatus having a contact-charging system in which a contact-charging member contacts a surface of a rotatable image bearing member, said image bearing member is charged with said contact-charging member to which a predetermined charging voltage is applied, and said image bearing member can rotate in a reverse direction to a rotation direction in image forming operation, wherein said image forming apparatus comprises:

a voltage selecting device that switches a voltage applied to said contact-charging member to be different from a voltage in a time period of the image forming operation while said image bearing member is rotated in a reverse direction to the rotation direction in the image forming operation, wherein said contact-charging member is also used as a cleaning member that cleans a surface of said image bearing member.

8. An image forming apparatus having a contact-charging system in which a contact-charging member contacts a surface of a rotatable image bearing member, said image bearing member is charged with said contact-charging member to which a predetermined charging voltage is applied, and said image bearing member can rotate in a reverse direction to a rotation direction in image forming operation, wherein said image forming apparatus comprises:

a voltage selecting device that switches a voltage applied to said contact-charging member to be different from a voltage in a time period of the image forming operation while said image bearing member is rotated in a reverse direction to the rotation direction in the image forming operation, wherein said contact-charging member has a configuration of a blade.

9. An image forming apparatus having the contact-charging system in which a contact-charging member contacts a surface of a rotatable image bearing member, said image bearing member is charged with said contact-charging member to which a predetermined charging voltage is applied, and said image bearing member can rotate in a reverse direction to a rotation direction in image forming operation, wherein said image forming apparatus comprises:

a voltage selecting device that switches a voltage applied to said contact-charging member to be different from a voltage in a time period of the image forming operation while said image bearing member is rotated in a reverse direction to the rotation direction in the image forming operation, wherein said voltage selecting device switches the charging voltage applied to said contact-charging member to the second predetermined charging voltage different from the first predetermined charging voltage in the image forming operation by grounding said contact-charging member while said image bearing member is rotating in the reverse direction.

10. An image forming apparatus having the contact-charging system in which a contact-charging member contacts a surface of a rotatable image bearing member, said image bearing member is charged with said contact-charging member to which a predetermined charging voltage is applied, and said image bearing member can rotate in a reverse direction to a rotation direction in image forming operation, wherein said image forming apparatus comprises:

a voltage selecting device that switches a voltage applied to said contact-charging member to be different from a voltage in a time period of the image forming operation while said image bearing member is rotated in a reverse direction to the rotation direction in the image forming operation, wherein said voltage selecting device switches the charging voltage applied to said contact-charging member to the second predetermined charging voltage different from the first predetermined charging voltage in the image forming operation by superimposing an AC component on a DC voltage while said image bearing member is rotating in the reverse direction.

11. An image forming apparatus having the contact-charging system in which a contact-charging member contacts a surface of a rotatable image bearing member, said image bearing member is charged with said contact-charging member to which a predetermined charging voltage is applied, and said image bearing member can rotate in a reverse direction to a rotation direction in image forming operation, wherein said image forming apparatus comprises:

a voltage selecting device that switches a voltage applied to said contact-charging member to be different from a voltage in a time period of the image forming operation while said image bearing member is rotated in a reverse direction to the rotation direction in the image forming operation, wherein said voltage selecting device switches the charging voltage applied to said contact-charging member to the second predetermined charging voltage different from the first predetermined charging voltage in the image forming operation just after a stopping signal for stopping said image bearing member is transmitted.

12. An image forming apparatus having a contact-charging system in which a contact-charging member contacts a surface of a rotatable image bearing member, said image bearing member is charged with said contact-charging member to which a predetermined charging voltage is applied, and said image bearing member can rotate in a reverse direction to a rotation direction in image forming operation, wherein said image forming apparatus comprises:

a voltage selecting device that switches a voltage applied to said contact-charging member to be different from a voltage in a time period of the image forming operation while said image bearing member is rotated in a reverse direction to the rotation direction in the image forming operation, wherein said image bearing member rotates in a reverse direction to a position where a part of the surface of said image bearing member in which the toner is transferred from said contact-charging member passes a cleaning member which cleans the surface of said image bearing member when said image bearing member rotates in a direction reverse to a rotation direction in the image forming operation.

13. A method of forming an image comprising steps of:

contacting a surface of a rotating image bearing member with a contact charging member;

charging said image bearing member by applying a first predetermined charging voltage to said contact-charging member in an image forming operation;

rotating said image bearing member in a rotation reverse to a rotation direction of said image bearing member in the image forming operation;

switching the charging voltage applied to said contact-charging member to a second predetermined charging voltage different from the first predetermined charging voltage in the image forming operation;

transferring a residual toner stuck on said contact-charging member onto said image bearing member; and removing the transferred residual toner from said image bearing member in a next image forming operation.

14. An image forming apparatus comprising:

a rotatable image bearing member;

a contact-charging member which contacts a surface of said image bearing member, wherein said contact-charging member charges said image bearing member by applying a first predetermined voltage to said contact-charging member for an image forming operation, wherein a second predetermined voltage is applied to said contact-charging member after the image forming operation to transfer residual toner from the contact-charging member to the image bearing member, and wherein the second predetermined voltage is applied to said contact-charging member as said image bearing member starts rotating in a reverse rotation direction to a rotation direction of the image bearing member for the image formation operation.

15. The image forming apparatus according to claim 14, wherein said contact-charging member serves as a cleaning member that cleans a surface of said image bearing member.

16. The image forming apparatus according to claim 14, wherein said contact-charging member is a blade, a part of said blade contacting a surface of said image bearing member.

17. The image forming apparatus according to claim 14, wherein the second predetermined voltage is a ground voltage.

18. The image forming apparatus according to claim 14, wherein the second predetermined voltage has a potential of a reverse polarity to the first predetermined voltage.

19. An image forming apparatus comprising:

a rotatable image bearing member;

a contact-charging member which contacts a surface of said image bearing member, wherein said contact-charging member charges said image bearing member by applying a first predetermined voltage to said contact-charging member for an image forming operation, wherein a second predetermined voltage is applied to said contact-charging member after the image forming operation to transfer residual toner from the contact-charging member to the image bearing member, and wherein the second predetermined voltage is formed by applying an AC voltage to said contact-charging member.

* * * * *